US005721469A

United States Patent [19]

Kim et al.

[11] Patent Number: 5,721,469

[45] Date of Patent: Feb. 24, 1998

[54] ELECTRON GUN FOR CATHODE RAY TUBES

[75] Inventors: Sang-Kyun Kim, Seoul; Seok-Bong Son; Chang-Seob Kim, both of Suwon; Bong-Wook Jung, Seoul, all of Rep. of Korea

[73] Assignee: Samsung Display Devices Co., Ltd., Kyungki-do, Rep. of Korea

[21] Appl. No.: 616,873

[22] Filed: Mar. 15, 1996

[30] Foreign Application Priority Data

Apr. 25, 1995 [KR] Rep. of Korea ..... 95-8496 U

[51] Int. Cl.[6] ..... H01J 29/50

[52] U.S. Cl. ..... 313/446; 313/417

[58] Field of Search ..... 313/409, 417, 313/410–11, 414, 444, 446, 451, 456

[56] References Cited

U.S. PATENT DOCUMENTS 4,101,801 7/1978 Collins ..... 313/451 X 4,112,327 9/1978 Eisele ..... 313/446 X 5,099,170 3/1992 Koizumi ..... 313/414 X

*Primary Examiner*—Ashok Patel

*Assistant Examiner*—Mark Haynes

*Attorney, Agent, or Firm*—Lowe, Price, LeBlanc & Becker

[57] ABSTRACT

An electron gun for cathode ray tubes which is easily assembled and reduces the cost is disclosed. The electron gun has a cathode holding structure. The cathode holding structure includes a support bracket which is fixedly fitted in the first electrode. The support bracket is provided with a plurality of insert holes spaced apart from each other. A plurality of hollow cases are received in the insert holes of the support bracket respectively and fixed to the support bracket. A cathode is concentrically received in each hollow case. The cathode holding structure also has an insulating material which is filled in the hollow case in order to hold and insulate the cathode in the hollow case. In the present invention, the gap between the cathodes and first electrode of the electron gun is easily adjusted thereby preventing the inferiority of the electron gun.

3 Claims, 4 Drawing Sheets

ELECTRON GUN FOR CATHODE RAY TUBES

BACKGROUND OF THE INVENTION

1. Field of the Invention

The present invention relates in general to an electron gun used for producing, controlling and converging a plurality of electron beams in a cathode ray tube and, more particularly, to a structural improvement in such an electron gun for holding the cathodes with a simple holding structure, to thereby improve the assembling precision and reduce the cost of the electron gun.

2. Description of the Prior Art

As well known to those skilled in the art, a typical color picture tube is a cathode ray tube having three different colors of phosphors and includes three electron guns. The three electron guns are mounted in the neck portion of the cathode ray tube in order to produce R (red), G (green) and B (blue) electron beams. An example of such typical electron guns for cathode ray tubes is shown in FIG. 1. Therein, the typical electron gun comprises a cathode 1 which produces thermal electrons. The above electron gun also includes six electrodes, that is, first to sixth electrodes $G_1$, $G_2$, $G_3$, $G_4$, $G_5$ and $G_6$ which are adapted for accelerating, converging and controlling the thermal electrons emitted from the cathode 1. In the electron gun, the cathode 1 and electrodes $G_1$, $G_2$, $G_3$, $G_4$, $G_5$ and $G_6$ are arranged in order such that they are spaced apart from each other by predetermined distances. The above cathode and electrodes are also welded to a pair of axially extending bead glasses 2 at their both side ends, thereby being fixed in their places in the electron gun. The above electron gun further includes a shield cup 3 which is fixed in front of the bead glasses 2.

In the operation of the above electron gun, the third and fifth electrodes $G_3$ and $G_5$ are applied with the same electrical potential, while the fourth and sixth electrodes $G_4$ and $G_6$ are applied with the same electrical potential. Thus, two electron lenses are formed in the electron gun by the third to sixth electrodes $G_3$ to $G_6$. The two electron lenses converge the electron beams emitted from the cathode 1. The electron beams of the cathode 1 are accelerated by the first and second electrodes $G_1$ and $G_2$ and in turn are preliminarily converged by the second and third electrodes $G_3$ and $G_4$. The preliminarily converged electron beams are, thereafter, repeatedly converged by the fourth and fifth electrodes $G_4$ and $G_5$ and by the fifth and sixth electrodes $G_5$ and $G_6$. Each electron beam thus has a minimum sectional area when it is focused on a phosphor screen of the cathode ray tube.

In the above electron gun, the cathode 1 must be precisely fixed in its place and insulated from the electrodes $G_1$ to $G_6$.

FIGS. 2 and 3 show an example of typical cathode holding structures used in the typical electron guns. As shown in these drawings, a cathode structure is provided in the first electrode $G_1$ of the electron gun. The above cathode structure includes a cathode 1, a case 5 and an insulating material 4 filled in the space between the cathode 1 and case 5.

However, the above cathode holding structure has the following problem. That is, the above cathode holding structure may change the positions and intervals of the other electrodes when the case 5 is fixed in relation to the first electrode $G_1$. The above cathode structure may cause the electron gun to the inferior.

FIGS. 4 and 5 show another example of the typical cathode holders for electron guns. As shown in the drawings, an insulating structure is provided in the first electrode $G_1$ of the electron gun. The above insulating structure includes one external case 5*a* which is fixedly received in the first electrode $G_1$. A plurality of first internal cases 5*b* are arranged in the external case 5*a*. The internal cases 5*b* are spaced apart from each other at regular intervals. Filled in the space defined in the external case 5*a* is an external insulating material 4*a*. Each internal case 5*b* of the above insulating structure holds a cathode structure. The cathode structure, which is received in each internal case 5*b*, comprises a cathode 1, an internal insulating material 4*b* and a second internal case 5*c*.

However, the above cathode holding structure has the following problems. That is, it is very difficult to form the insulating structure by placing the first internal cases 5*b* in the external insulating material 4*a*. Thus, the above cathode holding structure increases the cost of the electron gun. Another problem of the above cathode holding structure is that the holding structure has alot of parts which complicates the production process and increases the cost of the electron gun.

SUMMARY OF THE INVENTION

It is, therefore, an object of the present invention to provide an electron gun for cathode ray tubes in which the above problems can be overcome and which is easily assembled and reduces the cost with a simple cathode holding structure.

In order to accomplish the above object, the present invention provides an electron gun for cathode ray tubes comprising a cathode for producing electron beams and a plurality of electrodes including a first electrode and adapted for accelerating, controlling and converging the electron beams produced by the cathode. The above electron gun further comprises a cathode holding structure. The cathode holding structure includes a support bracket which is sized to fit within the first electrode. The support bracket is provided with a plurality of insert holes spaced apart from each other. A plurality of hollow cases are respectively received in the insert holes of the support bracket and fixed to the support bracket. A cathode is concentrically received in each hollow case. The cathode holding structure also includes an insulating material which is filled in the hollow case and adapted for holding and insulating the cathode in the hollow case.

As the electron gun of this invention has a simple cathode holding structure, the number of parts of the electron gun is reduced, thus facilitating assembly into the electron gun. The present invention improves the productivity of the electron gun for cathode ray tubes. As the cathode structures having the cathodes are slidably received in the insert holes of the support bracket prior to be fixed to the bracket, it is easy to adjust the gap between the cathodes and first electrode of the electron gun to inferior production of the electron gun. The present invention also reduces the cost of the electron gun as the electron gun can be easily assembled due to its simple cathode holding structure.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
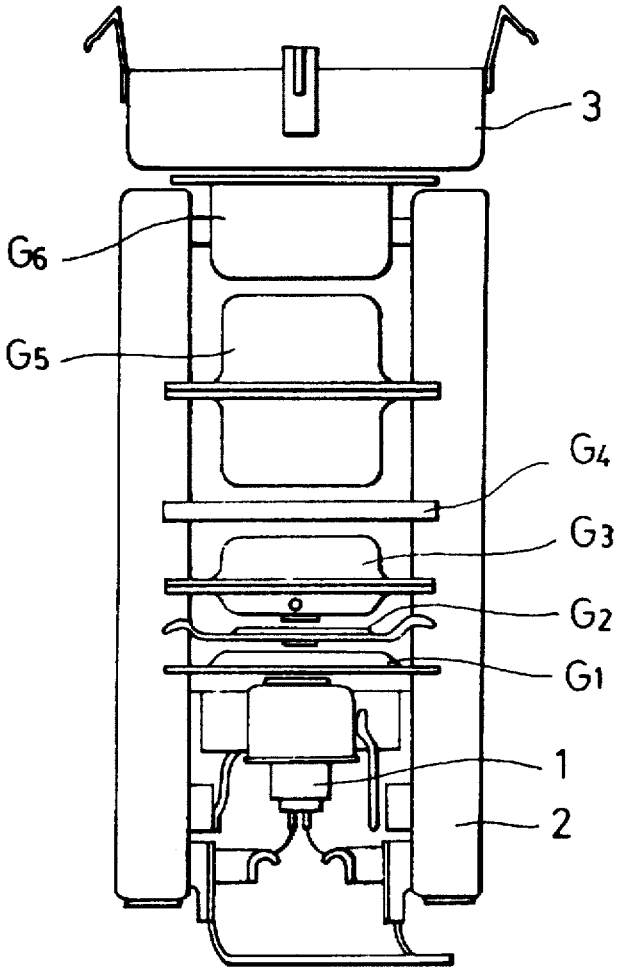
FIG.1 (PRIOR ART)
FIG. 1 is a view showing the construction of a typical electron gun for cathode ray tubes.
Figure 2:
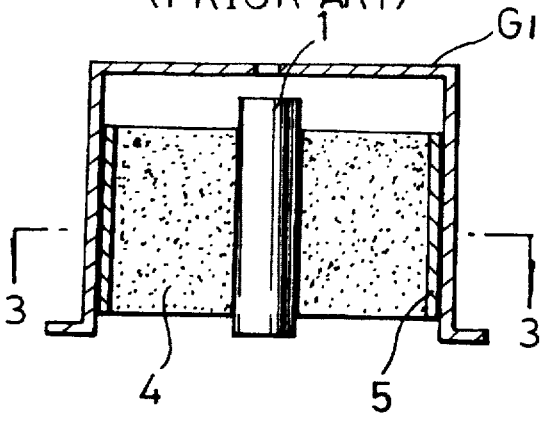
FIG.2 (PRIOR ART)
FIG. 2 is a sectional view of an example of a typical cathode holding structure used in an electron gun for cathode ray tubes.
Figure 3:
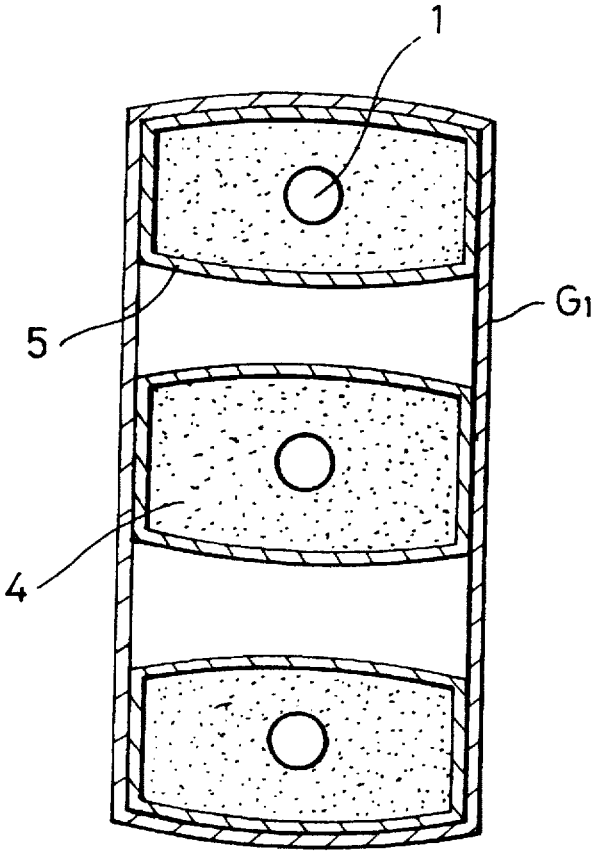
FIG.3 (PRIOR ART)
FIG. 3 is a sectional view of the above cathode holding structure taken along the section line 3—3 of FIG. 2.
Figure 4:
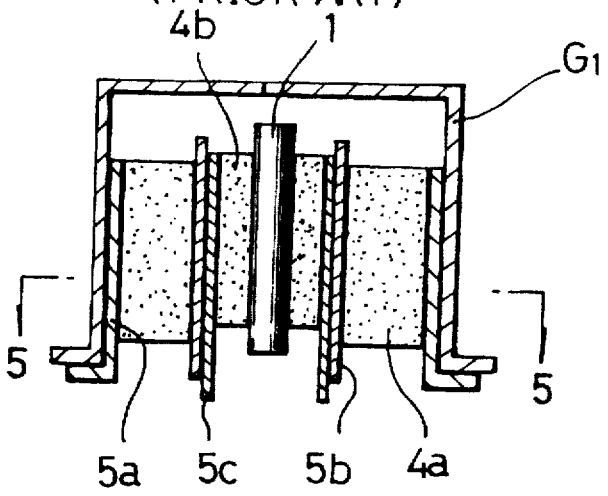
FIG.4 (PRIOR ART)
FIG. 4 is a sectional view of another example of a typical cathode holding structure used in an electron gun for cathode ray tubes.
Figure 5:
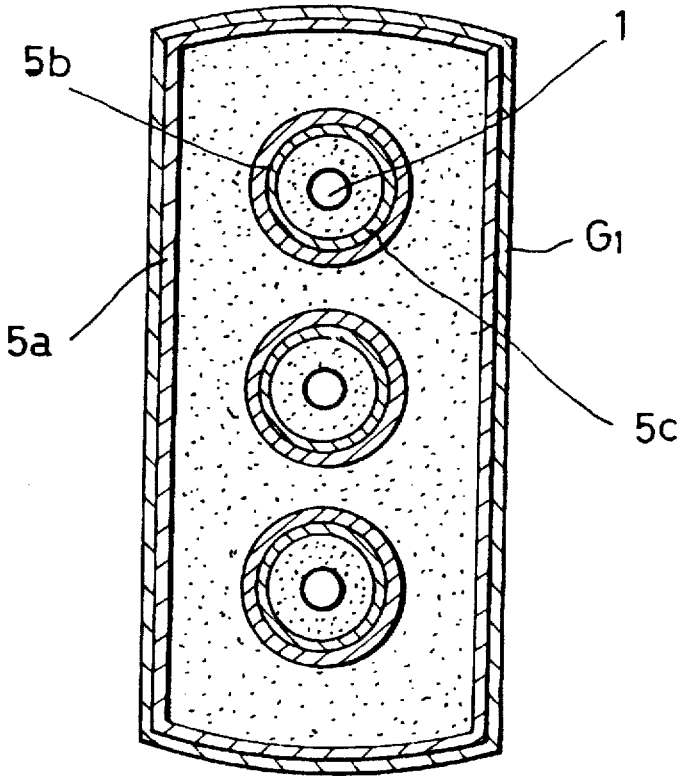
FIG.5 (PRIOR ART)
FIG. 5 is a sectional view of the above cathode holding structure taken along the section line 5—5 of FIG. 4.
Figure 6:
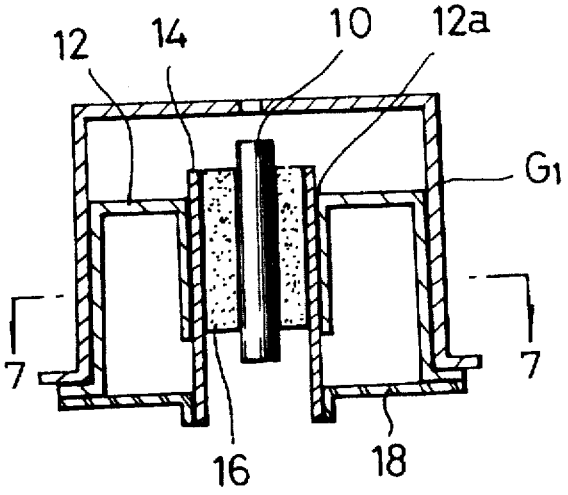
FIG. 6 is a sectional view of a cathode holding structure used in an electron gun for cathode ray tubes in accordance with a preferred embodiment of the present invention.
Figure 7:
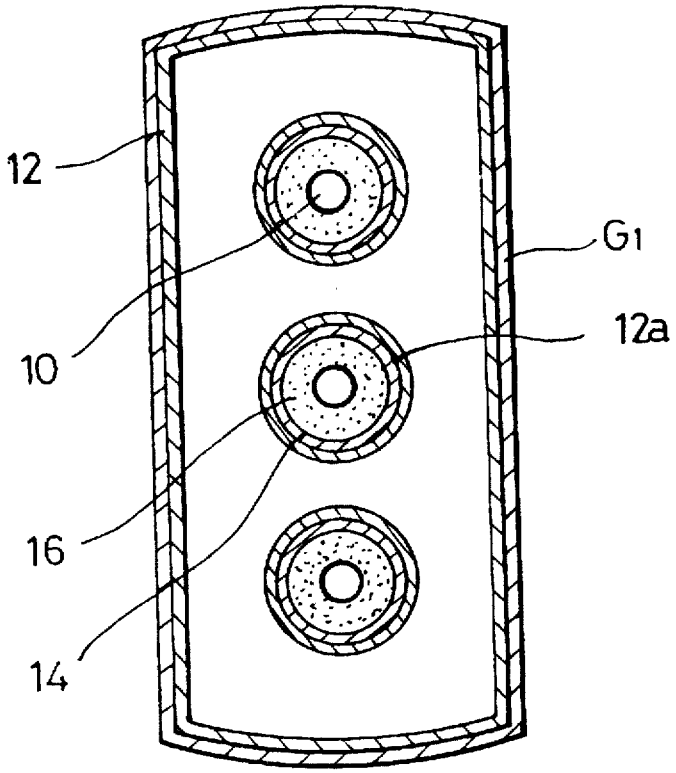
FIG. 7 is a sectional view of the cathode holding structure of the present invention taken along the section line 7—7 of FIG. 6.

FIGS. 6 and 7 show the construction of a cathode holding structure used in an electron gun for cathode ray tubes in accordance with a preferred embodiment of the present invention. In these drawings, reference numeral 10 denotes a cathode of the electron gun which produces electron beams.

As shown in the drawings, three cathodes 10 are provided in the first electrode $G_1$ of the electron gun such that the cathodes 10 are spaced apart from each other at regular intervals. The cathode holding structure of the present invention includes a metal support bracket 12 which is fixedly fitted (i.e. sized to fit in the first electrode $G_1$. The above support bracket 12 has a plurality of insert holes **12*a* which are spaced apart from each other at regular intervals. A cathode structure is received in each insert hole 12*a*. The above cathode structure comprises one cathode 10, a hollow case 14 and an insulating material 16. In each cathode structure, the hollow case 14 is slidably received in an associated insert hole 12*a* of the support bracket 12. The cathode 10 is concentrically placed in the hollow case 14, while the insulating material 16 is filled in the space defined in the hollow case 14 with the cathode 10**.

The above cathode structure also includes an auxiliary bracket 18. The auxiliary bracket 18 is fixed to the lower end of the support bracket 12, thereby supporting the lower section of the cathode structure. Due to the auxiliary bracket 18, it is possible not only to precisely adjust the intervals and parallelism of the cathodes 10 but also to precisely adjust the alignment of the cathodes 10 relative to the electron beam passing holes of the first electrode $G_1$.

In order to assemble the above cathode holding structure, the support bracket 12 is fixedly fitted in the first electrode $G_1$. Thereafter, the cathode structures are received in the insert holes 12A of the support bracket 12 respectively. In each cathode structure in the above state, the cathode 10 is maintained in its place due to the insulating material 16 which is filled in the hollow case 14. Thereafter, the hollow cases 14 of the cathode structures are fixed to the support bracket 12, thus fixing the cathode structures to the support bracket 12.

In the above state, the position of each cathode 10 in the hollow case 14 is maintained by the insulating material 16 filled in the case 14. The hollow cases 14 are slidably inserted in the insert holes 12A of the support bracket 12 and welded to the support bracket 12. It is thus possible to precisely adjust the interval between the cathodes 10 and the first electrode $G_1$ in the electron gun.

As described above, the present invention provides an electron gun for cathode ray tubes. The electron gun of the present invention is provided with a simple structure for holding the cathodes. The above cathode holding structure includes a support bracket which is fixedly fitted in the first electrode of the electron gun. The above bracket has a plurality of insert holes spaced apart from each other. A cathode structure is fitted in each insert hole of the support bracket. Each cathode structure comprises a hollow case which is received in each insert hole of the support bracket and fixed to the bracket. A cathode is concentrically received in the hollow case. The cathode structure also includes an insulating material which is filled in the hollow case with the cathode. The insulating materials holds the cathode in the hollow case while insulating the cathode from the electrodes. As the electron gun of this invention has the simple cathode holding structure, the number of parts of the electron gun is reduced thereby being easily assembled into the electron gun. The present invention thus improves the productivity of the electron gun for cathode ray tubes. As the cathode structures having the cathodes are slidably received in the insert holes of the support bracket prior to be fixed to the bracket, it is easy to adjust the gap between the cathodes and first electrode of the electron gun thereby preventing the inferiority of the electron gun. Another advantage of the present invention is that invention reduces cost as the electron gun can be easily assembled due to its simple cathode holding structure.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An electron gun for cathode ray tubes comprising a cathode for producing electron beams and a plurality of electrodes including a first electrode and adapted for accelerating, controlling and converging the electron beams produced by said cathode, further comprising:

a cathode holding structure having:

a support bracket mounted in said first electrode, said support bracket having a plurality of insert holes spaced apart from each other;

a plurality of hollow cases respectively received in said insert holes and fixed to the support bracket;

a cathode concentrically received in each hollow case; and an insulating material filled in each said hollow case around said cathode to hold and insulate said cathode in the hollow case.

2. The electron gun for cathode ray tubes according to claim 1, wherein said cathode holding structure further comprises an auxiliary bracket fitted over lower end portions of said hollow cases to support a lower section of said cathode holding structure, said auxiliary bracket being fixed to said hollow cases and to said support bracket.

3. The electron gun for cathode ray tubes according to claim 1, wherein said support bracket is formed of metal.

* * * * *